US008080132B2

(12) United States Patent
Scherb et al.

(10) Patent No.: US 8,080,132 B2
(45) Date of Patent: Dec. 20, 2011

(54) DEVICE FOR STABILIZING A WEB

(75) Inventors: Thomas Scherb, Sao Paulo (BR); Carlos Luiz Silva, Campo Limpo (BR)

(73) Assignee: Voith Patent GmbH, Heidenheim (DE)

( * ) Notice: Subject to any disclaimer, the term of this patent is extended or adjusted under 35 U.S.C. 154(b) by 1125 days.

(21) Appl. No.: 11/573,424

(22) PCT Filed: Jul. 6, 2005

(86) PCT No.: PCT/EP2005/053226

§ 371 (c)(1),
(2), (4) Date: Apr. 6, 2007

(87) PCT Pub. No.: WO2006/015918

PCT Pub. Date: Feb. 16, 2006

(65) Prior Publication Data

US 2008/0053632 A1 Mar. 6, 2008

(30) Foreign Application Priority Data

Aug. 9, 2004 (DE) ..... 10 2004 038 769

(51) Int. Cl.

| | |
|---|---|
| ***D21G 9/00*** | (2006.01) |
| ***D21F 7/00*** | (2006.01) |
| ***D21F 11/00*** | (2006.01) |
| ***B65H 23/28*** | (2006.01) |

(52) U.S. Cl. ..... 162/199; 162/193; 162/272; 34/444

(58) Field of Classification Search ..... 162/193, 162/198–199, 202, 263, 272, 289, 363; 34/114–123, 34/641, 444, 456, 359–361, 633; 226/7, 226/91–2, 97.1–97.3; 242/615, 615.11
See application file for complete search history.

(56) References Cited

U.S. PATENT DOCUMENTS

| | | | | | |
|---|---|---|---|---|---|
| 4,179,330 | A | * | 12/1979 | Page | 162/113 |
| 4,321,107 | A | * | 3/1982 | Page | 162/198 |
| 4,502,231 | A | * | 3/1985 | Fissmann et al. | 34/114 |
| 4,628,618 | A | * | 12/1986 | Virta et al. | 34/116 |
| 4,821,429 | A | * | 4/1989 | Sieberth | 34/114 |
| 4,856,205 | A | * | 8/1989 | Meyer et al. | 34/117 |
| 4,893,741 | A | | 1/1990 | Heinzmann | |
| 5,325,608 | A | * | 7/1994 | Mayer | 34/114 |
| 5,379,526 | A | * | 1/1995 | Haverinen | 34/114 |
| 5,503,716 | A | * | 4/1996 | Kivimaa et al. | 162/358.1 |

(Continued)

FOREIGN PATENT DOCUMENTS

| | | |
|---|---|---|
| DE | 19613939 | 10/1997 |

(Continued)

*Primary Examiner* — Jose A Fortuna

(74) *Attorney, Agent, or Firm* — Greenblum & Bernstein, PLC

(57) ABSTRACT

The invention relates to a device (11) for stabilising the transport of a material web (12) on the upper face of an air-permeable machine clothing (10), in particular a fibrous web. The device is located on the underside of the machine clothing directly upstream of an intake nip in the direction of travel (17) of the web, said nip being formed by a roll (5) and the machine clothing, and comprises a first negative-pressure zone (19) and at least one vacuum opening (20) that faces essentially in the opposite direction to the direction of travel of the web, communicating with the first negative-pressure zone of the device. This permits the boundary layer (23) of air that is carried along by the underside of the machine clothing to be at least partially sucked from said clothing into the first negative-pressure zone.

29 Claims, 3 Drawing Sheets

U.S. PATENT DOCUMENTS

| | | | | | |
|---|---|---|---|---|---|
| 5,577,294 | A | * | 11/1996 | Pollock | 15/345 |
| 5,738,760 | A | * | 4/1998 | Svanqvist et al. | 162/193 |
| 5,759,352 | A | * | 6/1998 | Lau et al. | 162/272 |
| 5,779,184 | A | * | 7/1998 | Kaufmann et al. | 242/554.2 |
| 5,820,733 | A | * | 10/1998 | Mancini | 162/306 |
| 5,888,349 | A | * | 3/1999 | Lau et al. | 162/199 |
| 5,891,309 | A | * | 4/1999 | Page et al. | 162/281 |
| 5,933,981 | A | * | 8/1999 | Meschenmoser | 34/456 |
| 5,967,457 | A | * | 10/1999 | Wildenberg et al. | 242/615.4 |
| 6,260,287 | B1 | * | 7/2001 | Walker et al. | 34/455 |
| 6,328,852 | B1 | * | 12/2001 | McGary et al. | 162/199 |
| 6,648,198 | B2 | * | 11/2003 | Demers | 226/95 |
| 6,733,634 | B2 | * | 5/2004 | Van Rengen et al. | 162/363 |
| RE39,601 | E | * | 5/2007 | Svanqvist | 162/193 |
| 2002/0005264 | A1 | * | 1/2002 | McGary et al. | 162/202 |
| 2003/0089756 | A1 | * | 5/2003 | Demers | 226/95 |
| 2003/0221807 | A1 | | 12/2003 | Klerelid et al. | |
| 2004/0261962 | A1 | | 12/2004 | Klerelid et al. | |
| 2006/0278360 | A1 | * | 12/2006 | Solberg | 162/272 |
| 2008/0053632 | A1 | * | 3/2008 | Scherb et al. | 162/53 |

FOREIGN PATENT DOCUMENTS

| | | | | |
|---|---|---|---|---|
| EP | 1205415 | | | 5/2002 |
| JP | 01156263 | A | * | 6/1989 |
| JP | 01239186 | A | * | 9/1989 |
| WO | WO 2006015918 | A1 | * | 2/2006 |

* cited by examiner

DEVICE FOR STABILIZING A WEB

CROSS-REFERENCE TO RELATED APPLICATIONS

The present application is a U.S. National Stage of International Application No. PCT/EP2005/053226, filed Jul. 6, 2005, which claims priority under 35 U.S.C. §119 of German Patent Application No. 10 2004 038 769.9, filed Aug. 9, 2004.

BACKGROUND OF THE INVENTION

1. Field of the Invention

This invention relates to an apparatus for stabilizing the transport of a material web, in particular a fibrous web, which is guided on the top side of a covering whereby the apparatus is arranged on the bottom side of the covering and, looking in the web running direction, is directly in front of an intake nip formed by a roller and the covering.

2. Discussion of Background Information

In particular in the case of high web speeds, in the case of structured coverings with a rough and coarse top side and in the case of thin and light fibrous webs such as tissue webs there is a problem in that the guided material web is often lifted off the covering in the region of an intake nip formed by a roller and the covering, resulting in the formation of stripes and creases and, consequently, poor winding quality.

The reason for this is that rough meshes, for example, are very voluminous and therefore carry a great deal of air not only on the inside but also on the outside in the form of a boundary layer of air. When a material web guided on such a mesh runs into the intake nip formed by the mesh and a roller, the boundary layer of air carried along with the mesh is compressed in the intake nip on account of the shrinking volume, leading therein to the generation of a positive pressure which expends itself through the air-permeable mesh, thus resulting in the material web being lifted off. This effect arises in particular in the case of light material webs such as tissue webs.

SUMMARY OF THE INVENTION

The present invention provides an apparatus for stabilizing the transport of a material web in the region of an intake nip, with which the previously described disadvantages are eliminated.

The invention provides an apparatus having at least one suction opening which faces essentially in the opposite direction to the web running direction and communicates with the first negative-pressure zone of the apparatus such that the boundary layer of air carried along by the bottom side of the air-permeable covering is sucked at least in part from said covering into the first negative pressure zone.

Disclosed according to the prior-art portion is an apparatus for stabilizing the transport of a web-shaped product, in particular a fibrous web, which is guided on the top side of an air-permeable covering. In this case the apparatus is arranged on the bottom side of the covering and, looking in the web running direction, directly in front of an intake nip formed by a roller and the covering and has a first negative-pressure zone. The invention is characterized in that the apparatus has a guide element which is arranged such that a boundary layer of air carried along by the bottom side of the covering is diverted at least in part from the covering and directed into the first negative-pressure zone.

The present invention provides an apparatus for stabilizing the transport of a material web guided on a transport surface of an air-permeable covering including a first negative-pressure zone; and at least one suction opening arranged to face essentially in a direction opposite a web running direction and to communicate with the first negative-pressure zone in such a manner that a boundary layer of air carried along by the bottom side of the air-permeable covering is at least partially suctioned into the first negative-pressure zone, wherein the first negative-pressure zone is positionable on a side of the air-permeable covering opposite the material web.

In one embodiment, several suction openings are arranged one after the other in relation to a transverse direction of the air-permeable covering.

In another embodiment, the at least one suction opening extends in a transverse direction in relation to the air-permeable covering.

In yet another embodiment, one guide element which is arranged such that a boundary layer of air carried along by the bottom side of the covering is diverted at least in part from the air-permeable covering and to the suction opening.

In one embodiment, a guide element arranged in front of the first negative-pressure zone looking in the web running direction.

In another embodiment, the guide element has a guide face.

In yet another embodiment, the guide face faces with its one end side in the opposite direction to the web running direction toward the bottom side of the air-permeable covering, and with its other end side in the direction of the suction opening which faces in the opposite direction to the web running direction.

In one embodiment, the end of the guide face facing in the direction of the bottom side of the air-permeable covering is arranged in the direct vicinity of the bottom side of the air-permeable covering.

In another embodiment, the guide element is constructed such that, in the region of its end facing the bottom side of the air-permeable covering, the cross section tapers to a point in the direction of the air-permeable covering.

In yet another embodiment, the guide element extends essentially over an air-permeable width of the air-permeable covering.

In one embodiment, at least one suction opening faces essentially in the direction of the bottom side of the air-permeable covering, and communicates with the first negative-pressure zone of the apparatus.

In another embodiment, several suction openings are arranged one after the other in the transverse direction of the air-permeable covering.

In yet another embodiment, at least one suction opening extends in a transverse direction in relation to the air-permeable covering.

In one embodiment, the first negative-pressure zone is directly in front of an intake nip formed by a roller and the air-permeable covering.

In another embodiment, a second negative-pressure zone is formed between the first negative-pressure zone and the intake nip.

In yet another embodiment, wherein the first and the second negative-pressure zones coincide.

In one embodiment, a doctor blade acting on the roller is arranged directly in front of the intake nip such that a boundary layer of air carried along by the roller is diverted from the roller.

In another embodiment, at least one of the first or second negative-pressure zone is formed in the region between the intake nip, the doctor blade and the guide element.

In yet another embodiment, a third negative-pressure zone acting on the bottom side of the covering is formed in front of the guide element looking in the web running direction.

In one embodiment, the apparatus finds application in a transfer apparatus.

In another embodiment, the transfer apparatus is arranged between a drying apparatus and a winding apparatus of a tissue machine.

In yet another embodiment, the covering is at least one of structured, has a rough surface, or is voluminous.

In one embodiment, wherein the covering is a belt, embossing belt, felt, embossing felt, or membrane.

In another embodiment, the covering is a Spectra membrane or TAD (through air dryer) belt.

In yet another embodiment, the material web comprises a fibrous web.

In one embodiment, the suction opening extends essentially over a width of the air-permeable covering.

In another embodiment, the suction opening extends essentially over a width of the air-permeable covering.

In yet another embodiment, the drying apparatus is a Yankee drying cylinder.

The present invention also provides a method for stabilizing the transport of a material web guided on a transport surface of an air-permeable covering including creating a first negative-pressure zone, and at least partially suctioning a boundary layer of air carried along by the bottom side of the air-permeable covering into the first negative-pressure zone through at least one opening arranged to face essentially in a direction opposite a web running.

According to one embodiment of the present invention, provision is made for at least one suction opening, which faces essentially in the opposite direction to the web running direction and communicates with the first negative-pressure zone, such that the boundary layer of air carried along by the bottom side of the covering is sucked, at least in part, from the covering into the first negative-pressure zone.

Hence the boundary layer of air carried along by the covering is sucked through the suction opening, which faces in the opposite direction to the web running direction and communicates with the negative-pressure zone, into a first negative-pressure zone before the boundary layer of air can enter the intake nip, be compressed and generate a positive pressure which expends itself through the air-permeable covering and leads to the material web guided on the covering being lifted off.

According to one embodiment, to divert the boundary layer of air over the width of the covering, in particular over the air-permeable width of the covering, into the first negative-pressure zone, it makes sense for several suction openings to be arranged one after the other in the transverse direction of the covering, in particular over the air-permeable width of the covering.

According to one embodiment, to achieve a similar effect as that described in the above section, it can also make sense in some applications to provide one suction opening which extends in the transverse direction, in particular essentially over the air-permeable width of the covering.

According to one embodiment, to increase the effectiveness of the suction opening, which faces in the opposite direction to the web running direction, it makes sense to provide a guide element arranged such that the boundary layer of air carried along by the bottom side of the covering is directed, at least in part, from the covering to the suction opening.

In this case the guide element is arranged in front of the first negative-pressure zone looking in the web running direction.

According to one embodiment, the guide element has a guide face.

According to one embodiment, to divert the boundary layer of air carried along by the covering as effectively and completely as possible from the covering, it makes sense for the guide face of the guide element to face with its one end side in the opposite direction to the web running direction at an angle toward the bottom side of the covering and with its other end side in the direction of the suction opening which faces in the opposite direction to the web running direction. The boundary layer of air can thus be "peeled off" from the covering and directed to the suction opening particularly effectively.

The diversion of the boundary layer of air is optimized further when the end of the guide face facing in the direction of the bottom side of the covering is arranged in the direct vicinity of the bottom side of the covering such that the distance between the end and the bottom side of the covering is as small as possible, thus enabling only a small fraction of the boundary layer of air to "escape" in the gap between the covering and the end.

According to one embodiment, to improve the effectiveness of the guide element it also helps for the guide element to be constructed such that, in the region of its end facing the bottom side of the covering, the cross section tapers to a point in the direction of the covering. The "peeled off" boundary layer of air can thus be diverted from the covering with the least possible swirl and no pressure build-up.

According to one embodiment, for the effective diversion of the boundary layer of air it also makes sense for the guide element to extend in the transverse direction of the covering in particular essentially over the air-permeable width of the covering.

According to another embodiment, the guide element can be cost-effectively manufactured as a guide plate, for example by way of a forming process or the like.

One possibility for constructing the inventive apparatus is for the apparatus to have a suction opening which faces essentially in the direction opposite to the web running direction and communicates with the first negative-pressure zone of the apparatus. In this case the suction opening is arranged behind the guide element looking in the web running direction and faces in the direction opposite to the web running direction in the direction of the current of "peeled off" air such that the boundary layer of air "peeled off" by the guide element can enter the first negative-pressure zone directly via the suction opening.

According to one embodiment, to prevent a new boundary layer of air building up after a boundary layer of air was "peeled off" the bottom side of the covering by the interaction of the guide element and the first negative-pressure zone it can make sense for the apparatus to have at least one suction opening which faces essentially in the direction of the bottom side of the covering and communicates with the first negative-pressure zone of the apparatus. The suction opening facing the bottom side of the covering is arranged in this case behind the guide element looking in the web running direction.

According to one embodiment, to prevent a new boundary layer of air developing in the transverse extension of the covering it makes sense for several suction openings facing the bottom side of the covering to be arranged one after the other in the transverse direction of the covering or for provision to be made for one suction opening which extends in the transverse direction, in particular essentially over the air-permeable width of the covering.

Similarly, to prevent a new boundary layer of air from building up ahead of the intake nip it can make sense for a second negative-pressure zone to be formed between the first negative-pressure zone and the intake nip.

Depending on the constructional embodiment it is possible for the second negative-pressure zone to be evacuated by a suction apparatus independent of the first negative-pressure zone or else for the first and the second negative-pressure zone to be evacuated by a joint suction apparatus.

Furthermore it is possible for the first negative-pressure zone to extend up to the intake nip. In this case the first and the second negative-pressure zones coincide.

According to one embodiment, to be able to divert the boundary layer of air carried along by the roller into the intake nip and thus prevent a positive pressure with subsequent lifting off of the web, another embodiment of the invention provides for a doctor blade acting on the roller to be arranged directly in front of the intake nip such that a boundary layer of air carried along by the roller is diverted from the roller.

Lifting off of the web is prevented particularly effectively when the first and/or the second negative-pressure zone is formed in the region between the intake nip, the doctor blade and the apparatus. This means that the guide element diverts the boundary layer of air from the bottom side of the covering, that the doctor blade diverts the boundary layer of air from the roller, and that the formation of a (first and/or second) negative-pressure zone prevents a new boundary layer of air from building up on the roller and on the bottom side of the covering.

According to one embodiment, to reduce the formation of the boundary layer of air on the approach to the apparatus it can make sense to form a third negative-pressure zone to act on the bottom side of the covering in front of the guide element looking in the web running direction.

The inventive apparatus can be used wherever there is a risk of the web being lifted off by a positive pressure generated by a boundary layer of air in the region of the intake nip. This risk exists in particular in the case of high web speeds (for example over 800 meters/min or in particular over 1100 meters/min) or in the case of long free transport sections of the covering unsupported by a roller (here it is possible for a boundary layer of air to develop over the long free transport section) or in the case of using voluminous and/or structured coverings such as belts or embossing belts or felts or embossing felts or membranes, in particular Spectra membranes or TAD (through air dryer) belts or in the case of transporting thin and light fibrous webs such as tissue webs.

Accordingly the inventive apparatus finds application preferably in a transfer apparatus which is arranged, for example, between a drying apparatus, in particular a Yankee drying cylinder, and a winding apparatus of a paper machine, in particular a tissue machine.

BRIEF DESCRIPTION OF THE DRAWINGS

The invention will be explained in more detail with reference to the following figures (not drawn to scale). In the drawing.

DETAILED DESCRIPTION OF THE INVENTION

Figure 1:
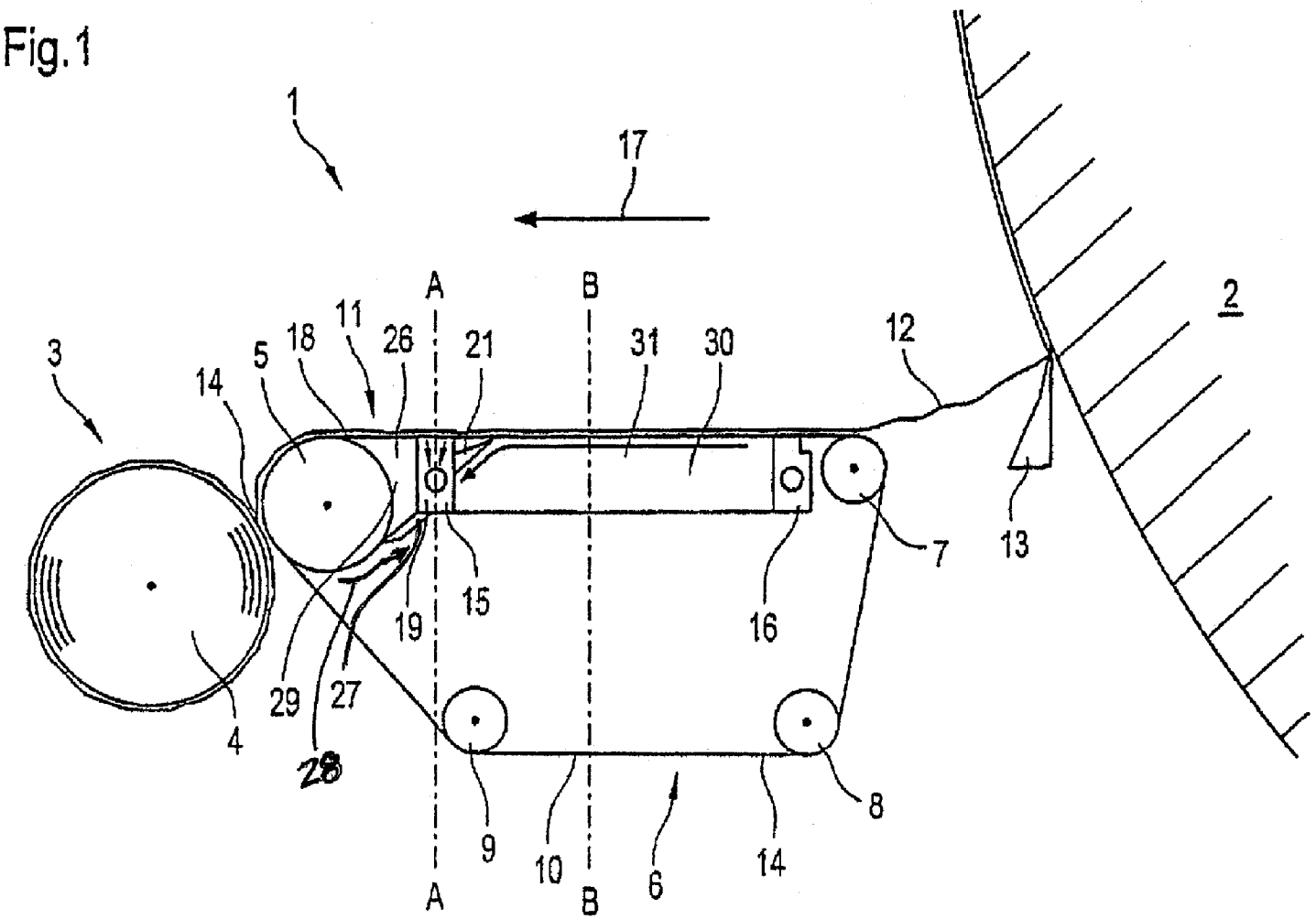
FIG. 1 shows, in a side view, a transfer apparatus on a tissue machine with an inventive apparatus for stabilizing the transport.

FIG. 1 shows, in a side view, a part of a tissue machine 1. The part presented shows a section of a Yankee drying cylinder 2 of a drying apparatus having a winding apparatus 3, a reel 4 and a roller constructed as a winding drum 5, as well as a transfer apparatus 6 comprising deflector rollers 7, 8, 9, the winding drum 5, a covering constructed as a TAD mesh and the inventive apparatus for stabilizing the transport 11.

A tissue paper web 12 is taken off the Yankee drying cylinder 2 by a crepe doctor blade 13. The accordingly creped tissue paper web 12 is then transferred with the help of a suction box 16 to the TAD mesh 10 and transported on the top side 14 of the TDA mesh 10 as far as the winding apparatus 3, then conveyed through a nip 140 formed between the reel 4 and the winding drum 5, and finally wound onto the reel 4.

In the embodiment in question the inventive apparatus 11 has a first suction box 15, a second suction box 29 and a third suction box 30.

The first suction box 15 is arranged, looking in the web running direction 17 of the tissue web 12, directly in front of an intake nip 18 formed by the TAD mesh 10 and the winding drum 5. The first suction box 15 generates a first negative-pressure zone 19.

The suction box 15 has several suction openings 20 (see FIG. 2) which are arranged one after the other in the transverse direction of the TAD mesh 10, face in the opposite direction to the web running direction and communicate with the first negative-pressure zone 19. Arranged in front of the suction openings 20 and hence in front of the first negative-pressure zone 19 looking in the web running direction 17 is a guide element which extends in the transverse direction of the mesh 10 and is constructed as a guide plate 21. The guide plate 21 extends in this case in the transverse direction essentially over the air-permeable width of the mesh 10. The guide element has a guide face 33. One end 24 of the guide face 33 faces in the opposite direction to the web running direction 17 in the direction of the bottom side 22 of the TAD mesh 10 and the other end 34 of the guide face 33 faces in the direction of the suction openings 20. Hence the boundary layer of air 23 carried along on the bottom side 22 of the TAD mesh 10 can be peeled off from the TAD mesh 10, diverted therefrom and directed via the suction openings 20 into the first negative-pressure zone 19. In the region of the end 24 of the guide face 33, the guide element 21 is constructed such that its cross section tapers to a point in the direction of the mesh 10. The "peeled off" boundary layer of air 23 can thus be diverted from the mesh 10 with the least possible swirl and no pressure build-up.

The diversion of the boundary layer of air 23 from the bottom side 22 of the TAD mesh 10 is optimized when the end 24 of the guide face 33 facing in the direction of the bottom side 22 of the mesh 10 is arranged in the direct vicinity of (here: in intermittent contact with) the bottom side 22 of the mesh 10 such that the distance between the end 24 and the bottom side 22 of the mesh 10 is as small as possible, thus enabling only a small fraction of the boundary layer of air 23 to "escape" in the gap between the mesh 10 and the end 24.

Furthermore, the suction box 15 has a suction opening 25 which extends in the transverse direction of the mesh 10 and faces in the direction of the bottom side 22 of the mesh 10 and communicates with the first negative-pressure zone 19. In this case the suction opening 25 is arranged behind the guide plate 21 looking in the web running direction 17.

The region in which the suction openings 20 and 25 are arranged extends essentially over the air-permeable width of the TAD mesh 10.

Arranged behind the first negative-pressure zone 19 in the web running direction 17 is the second suction box 29 which generates a second negative-pressure zone 26. The second negative-pressure zone 26 extends essentially as far as the intake nip 18 and as far as a doctor blade 27 acting on the winding drum 5.

Lifting off of the tissue paper web 12 is thus prevented particularly effectively because the boundary layer of air 23 is diverted from the bottom side 22 of the mesh 10 by the guide plate 21 and the first negative-pressure zone 19, a boundary layer of air 28 is diverted from the winding drum 5 by the doctor blade 27, and the build-up of a new boundary layer of air on the winding drum 5 and on the bottom side 22 of the mesh 10 ahead of the intake nip 18 is prevented by the formation of the second negative-pressure zone 26.

On the embodiment in question the first negative-pressure zone 19 and the second negative-pressure zone 26 are evacuated separately.

To reduce the formation of the boundary layer of air 23 on the approach to the apparatus, the third suction box 30 is arranged in front of the guide plate 21 looking in the web running direction in order to generate a third negative-pressure zone 31 acting on the bottom side 22 of the mesh 10. The third negative-pressure zone 31 acts on the bottom side 22 of the mesh 10 via a suction opening 32 which communicates with it.

Figure 2:
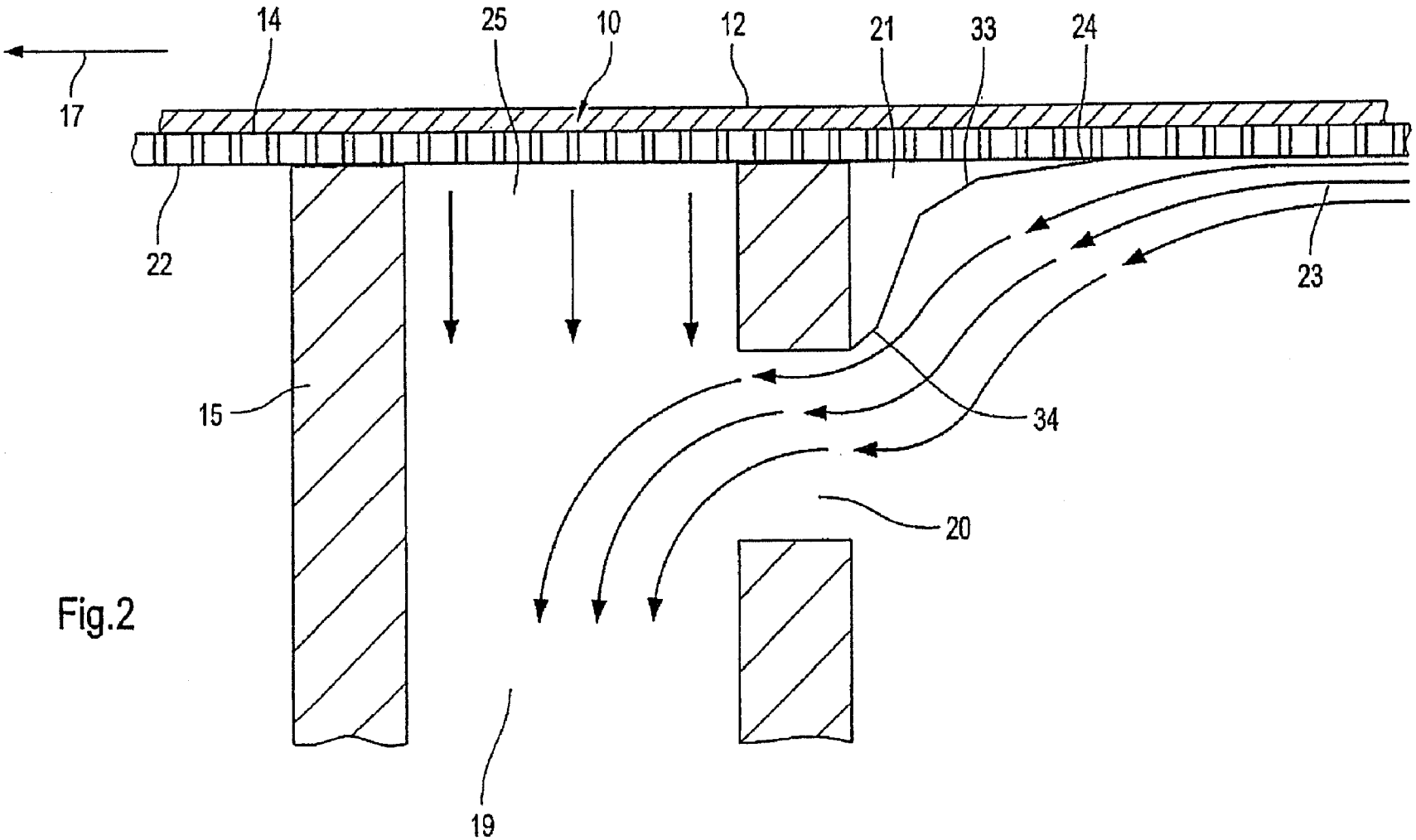
FIG. 2 shows sections of a magnified detail of the inventive apparatus from FIG. 1.

FIG. 2 shows sections of a magnified detail of the inventive apparatus 11. Evident is a part of the first suction box 15, by which a first negative-pressure zone 19 is formed. The suction box 15 has suction openings 20 facing in the opposite direction to the web running direction 17 and suction openings 25 facing in the direction of the bottom side 22 of the mesh 10, which communicate with the first negative-pressure zone 19. The guide element 21 is constructed in the region of the end 24 of the guide face 33 facing the bottom side 22 of the mesh 10 such that its cross section tapers to a point in the direction of the bottom side 22 and is arranged directly adjacent the bottom side 22.

The boundary layer of air 23 carried along with the mesh 10 is peeled off from the bottom side 22 of the mesh 10 by the pointed construction of the guide plate 21 in the region of the end 24 of the guide face and diverted by the guide plate 21 and directed into the suction opening 20 in the first negative-pressure zone 19.

Figure 3:
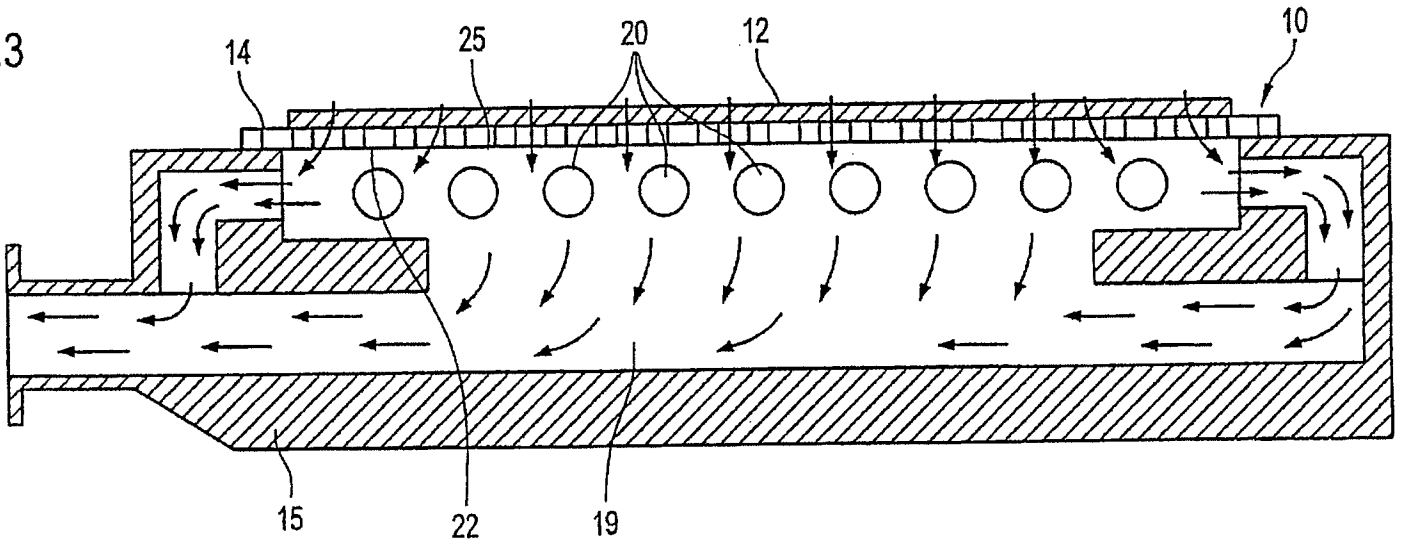
FIG. 3 shows a magnified detail of a part of the inventive apparatus from FIG. 1 in the cross-sectional direction A-A.

FIG. 3 shows the apparatus 11 along section line A-A. Evident is the first suction box 15 with the suction openings 20 facing in the opposite direction to the web running direction 17 and the suction openings 25 facing in the direction of the bottom side 22 of the mesh.

The suction openings 20 and 25 are arranged one after the other in the transverse extension of the mesh 10, whereby their arrangement extends essentially over the air-permeable width of the TAD mesh 10 (the mesh 10 in the embodiment in question is air-permeable over its entire width).

Figure 4:
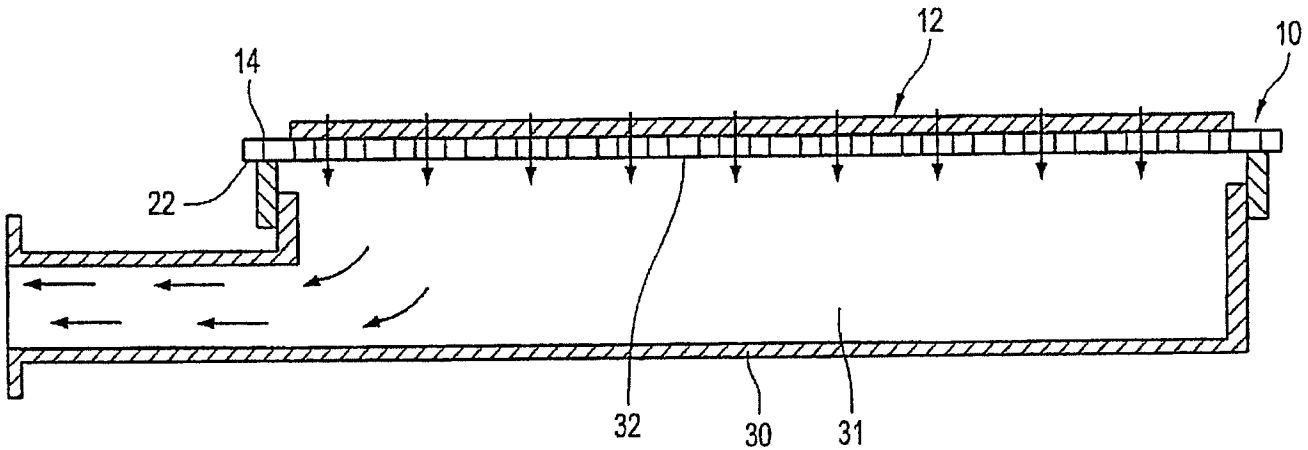
FIG. 4 shows a magnified detail of a part of the inventive apparatus from FIG. 1 in the cross-sectional direction B-B.

FIG. 4 shows the apparatus 11 along section line B-B. Evident is the third suction box 30 with the suction opening 32 which extends in the transverse direction of the mesh 10 and faces in the direction of the bottom side 22 of the mesh 10.

The suction openings 32 are arranged one after the other in the transverse extension of the mesh 10, whereby their arrangement extends essentially over the air-permeable width of the TAD mesh 10 (the mesh 10 in the embodiment in question is air-permeable over its entire width).

The invention claimed is:

1. An apparatus for stabilizing the transport of a material web guided on a transport surface of an air-permeable covering comprising:

a first negative-pressure zone; and at least one suction opening arranged to face essentially in a direction opposite a web running direction and to communicate with the first negative-pressure zone in such a manner that a boundary layer of air carried along by a bottom side of the air-permeable covering is at least partially suctioned into the first negative-pressure zone, wherein the first negative-pressure zone is positioned on a side of the air-permeable covering opposite the material web.

2. The apparatus according to claim 1, wherein several suction openings are arranged one after the other in relation to a transverse direction of the air-permeable covering.

3. The apparatus according to claim 1, wherein the at least one suction opening extends in a transverse direction in relation to the air-permeable covering.

4. The apparatus according to claim 3, wherein the suction opening extends essentially over a width of the air-permeable covering.

5. The apparatus according to claim 1, further comprising one guide element which is arranged such that a boundary layer of air carried along by the bottom side of the covering is diverted at least in part from the air-permeable covering and to the suction opening.

6. The apparatus according to claim 1, further comprising a guide element arranged in front of the first negative-pressure zone looking in the web running direction.

7. The apparatus according to claim 6, wherein the guide element has a guide face.

8. The apparatus according to claim 7, wherein the guide face faces with its one end side in the opposite direction to the web running direction toward the bottom side of the air-permeable covering, and with an other end side in the direction of the suction opening which faces in the opposite direction to the web running direction.

9. The apparatus according to claim 8, wherein the end of the guide face facing in the direction of the bottom side of the air-permeable covering is arranged in the direct vicinity of the bottom side of the air-permeable covering.

10. The apparatus according to claim 6, wherein the guide element is constructed such that, in a region of an end facing the bottom side of the air-permeable covering, a cross section tapers to a point in the direction of the air-permeable covering.

11. The apparatus according to claim 6, wherein the guide element extends essentially over an air-permeable width of the air-permeable covering.

12. The apparatus according to claim 1, wherein at least one suction opening faces essentially in the direction of the bottom side of the air-permeable covering, and communicates with the first negative-pressure zone of the apparatus.

13. The apparatus according to claim 12, wherein several suction openings are arranged one after the other in the transverse direction of the air-permeable covering.

14. The apparatus according to claim 12, wherein at least one suction opening extends in a transverse direction in relation to the air-permeable covering.

15. The apparatus according to claim 14, wherein the suction opening extends essentially over a width of the air-permeable covering.

16. The apparatus according to claim 1, wherein the first negative-pressure zone is directly in front of an intake nip formed by a roller and the air-permeable covering.

17. The apparatus according to claim 16, wherein a second negative-pressure zone is formed between the first negative-pressure zone and the intake nip.

18. The apparatus according to claim 17, wherein the first and the second negative-pressure zones coincide.

19. The apparatus according to claim 17, wherein at least one of the first or second negative-pressure zone is formed in the region between the intake nip, a doctor blade and the guide element.

20. The apparatus according to claim 17, wherein a third negative-pressure zone acting on the bottom side of the covering is formed in front of the guide element looking in the web running direction.

21. The apparatus according to claim 16, wherein a doctor blade acting on the roller is arranged directly in front of the intake nip such that a boundary layer of air carried along by the roller is diverted from the roller.

22. The apparatus according to claim 1, wherein the apparatus is arranged in a transfer apparatus.

23. The apparatus according to claim 22, wherein the transfer apparatus is arranged between a drying apparatus and a winding apparatus of a tissue machine.

24. The apparatus according to claim 23, wherein the drying apparatus is a Yankee drying cylinder.

25. The apparatus according to claim 1, wherein the covering is at least one of structured, has a rough surface, or is voluminous.

26. The apparatus according to claim 1, wherein the covering is a belt, embossing belt, felt, embossing felt, or membrane.

27. The apparatus according to claim 26, wherein the covering is a Spectra membrane or TAD (through air dryer) belt.

28. The apparatus according to claim 1, wherein the material web comprises a fibrous web.

29. A method for stabilizing the transport of a material web guided on a transport surface of an air-permeable covering comprising:

creating a first negative-pressure zone, and at least partially suctioning a boundary layer of air carried along by the bottom side of the air-permeable covering into the first negative-pressure zone through at least one opening arranged to face essentially in a direction opposite a web running direction, wherein the first negative-pressure zone is created on a side of the air-permeable covering opposite the material web.

* * * * *